US007870790B2

(12) United States Patent
Sato et al.

(10) Patent No.: US 7,870,790 B2
(45) Date of Patent: Jan. 18, 2011

(54) METHOD AND APPARATUS FOR EVALUATING FEELING OF HITTING GENERATED BY GOLF CLUB

(75) Inventors: Fumiaki Sato, Tokyo (JP); Wataru Ban, Tokyo (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 395 days.

(21) Appl. No.: 11/931,119

(22) Filed: Oct. 31, 2007

(65) Prior Publication Data

US 2008/0115582 A1 May 22, 2008

(30) Foreign Application Priority Data

Nov. 20, 2006 (JP) ..... 2006-312876

(51) Int. Cl.
*G01N 19/00* (2006.01)
*G63B 69/00* (2006.01)

(52) U.S. Cl. ..... 73/579; 73/649; 473/131; 473/151; 473/221

(58) Field of Classification Search ..... 73/579, 73/649, 11.04, 11.09, 12.01, 12.09; 473/151, 473/131, 221

See application file for complete search history.

(56) References Cited

U.S. PATENT DOCUMENTS

| | | | | |
|---|---|---|---|---|
| 6,441,745 | B1 * | 8/2002 | Gates | 340/669 |
| 6,532,818 | B2 * | 3/2003 | Blankenship | 73/579 |
| 7,308,818 | B2 * | 12/2007 | Considine et al. | 73/12.09 |
| 2002/0077189 | A1 * | 6/2002 | Tuer et al. | 473/151 |
| 2005/0215340 | A1 * | 9/2005 | Stites et al. | 473/233 |
| 2005/0261073 | A1 * | 11/2005 | Farrington et al. | 473/221 |
| 2006/0025229 | A1 * | 2/2006 | Mahajan et al. | 473/131 |
| 2006/0184336 | A1 * | 8/2006 | Kolen | 702/150 |

FOREIGN PATENT DOCUMENTS

JP 05-118952 A 5/1993

* cited by examiner

*Primary Examiner*—Helen C. Kwok
(74) *Attorney, Agent, or Firm*—Sughrue Mion, PLLC

(57) ABSTRACT

A method for evaluating feeling of hitting of a golf club, includes: measuring vibration of a golf club appearing in a circumferential direction of a shaft when a golf ball is hit by the golf club having the three-axis accelerometer attached to the shaft by a three-axis accelerometer; analyzing the vibration of the golf club along the circumferential direction of the shaft measured by the three-axis accelerometer by a hand-arm vibration measurement filter; and evaluating feeling of hitting of the golf club in accordance with a result of analysis of vibration of the golf club appearing along the circumferential direction of the shaft by the hand-arm vibration measurement filter.

4 Claims, 9 Drawing Sheets

METHOD AND APPARATUS FOR EVALUATING FEELING OF HITTING GENERATED BY GOLF CLUB

BACKGROUND OF THE INVENTION

1. Field of the Invention

The present invention relates a method and an apparatus for evaluating the feeling of hitting generated by a golf club when a golfer hits a golf ball by means of a golf club.

2. Description of the Related Art

Evaluation of a golf club has hitherto been performed by use of the hardness (flexure) of a shaft called flex and the torque of a shaft. Moreover, evaluating a torsional characteristic of a golf club by measurement of a torsional frequency of the golf club having a head, a shaft, and a grip has also been put forward (JP-A-5-118952).

SUMMARY OF THE INVENTION

However, all of the previously-described related-art techniques are for evaluating characteristics of a shaft and are not intended for evaluating the feeling of hitting (vibration transmitted to golfer's hands) generated when the golfer hits a golf ball by use of a golf club. Specifically, evaluation of characteristics of a shaft performed in the related art is different from evaluation of feeling of hitting perceived by the golfer.

The present invention is conceived under the circumstances and aims at providing a method and an apparatus which enable evaluation of feeling of hitting of a golf club perceived when a golfer hits a golf ball by use of a golf club.

The present inventors found that, in a case where a three-axis accelerometer is attached to a shaft of a golf club; where vibration of the golf club in a circumferential direction of the shaft appearing when a golf ball is hit (at the time of occurrence of an impact) is measured by means of the three-axis accelerometer; and where vibration of the golf club is analyzed by use of the hand-arm vibration measurement filter, feeling of hitting sensed when a golfer hits a golf ball with a golf club can be evaluated.

In order to achieve the object, the present invention provides a method for evaluating feeling of hitting of a golf club, including: measuring vibration of a golf club appearing in a circumferential direction of a shaft when a golf ball is hit by the golf club having the three-axis accelerometer attached to the shaft by a three-axis accelerometer; analyzing the vibration of the golf club along the circumferential direction of the shaft measured by the three-axis accelerometer by a hand-arm vibration measurement filter; and evaluating feeling of hitting of the golf club in accordance with a result of analysis of vibration of the golf club appearing along the circumferential direction of the shaft by the hand-arm vibration measurement filter.

Moreover, the present invention provides an apparatus for evaluating feeling of hitting of a golf club, including: a three-axis accelerometer attached to a shaft of a golf club, the three-axis accelerometer measuring vibration of the golf club appearing in a circumferential direction of the shaft when a golf ball is hit by the golf club; and a computer which captures a signal pertaining to the vibration measured by the three-axis accelerometer and which analyzes the vibration through use of a hand-arm vibration measurement filter.

According to the present invention, feeling of hitting of a golf club felt when a golfer hits a golf ball with the golf club can be evaluated.

DETAILED DESCRIPTION OF THE EMBODIMENTS

Figure 1:
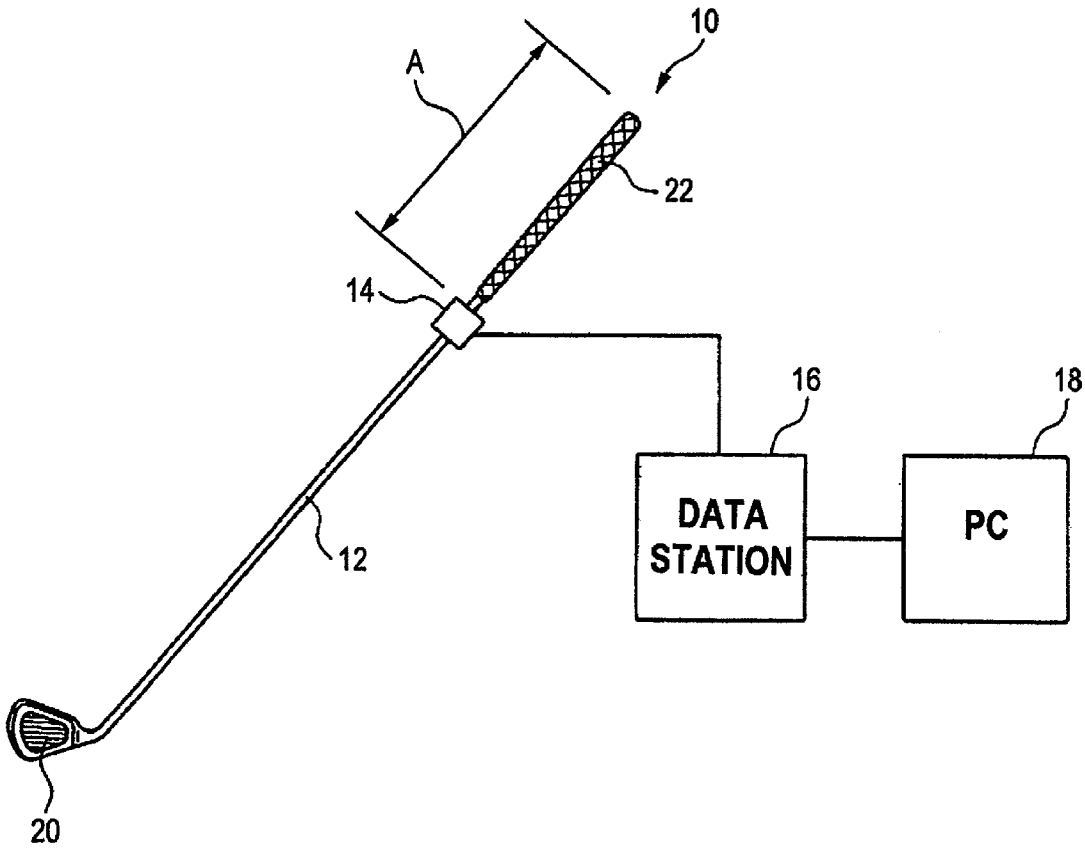
FIG. 1 is a descriptive view showing an embodiment of an apparatus for evaluating the feeling of hitting of a golf club according to the present invention.

The present invention will be described in more detail. In the present invention, vibration of a golf club developed in a circumferential direction of a shaft when a golf ball is hit by means of a golf club having a three-axis accelerometer attached to a shaft is measured by means of the three-axis accelerometer. In the present invention, the reason why the three-axis accelerometer is used as an accelerometer for measuring vibration is that use of the three-axis accelerometer enables separation of vibration components appearing in the circumferential direction of the shaft. In a uniaxial or two-axis accelerometer, vibration components appearing in the circumferential direction of the shaft cannot be separated well. Further, in the present invention, the reason why vibration appearing in the circumferential direction of the shaft is measured as vibration is that vibration appearing in the circumferential direction of the shaft corresponds to the feeling of hitting better than does vibration appearing in the axial direction of the shaft or vibration appearing in a direction from the toe to the heel, and a characteristic of the club appears well.

In the present invention, a three-axis accelerometer having a mass of 1 to 12 g, or a light-weight three-axis accelerometer having a mass of 2 to 5 g, is preferably used as the three-axis accelerometer such that measurement of vibration is not affected by the weight of the three-axis accelerometer. Since vibration sensed by the human ranges from 0.5 Hz to 2000 Hz, the light-weight three-axis accelerometer can perform sufficiently-effective measurement.

In the present invention, the three-axis accelerometer is preferably attached to a position close to a grip of the shaft in order to measure vibration close to that felt by the hands. Specifically, since the length of the grip generally ranges from 240 mm to 275 mm, a distance between a rear end of the shaft and the three-axis accelerometer is appropriately set to 250 mm to 300 mm.

When the three-axis accelerometer is attached to the shaft of the golf club, there is used a block-shaped jig in which a recess whose bottom assumes a circular-arc shape is formed in one surface and a surface of the jig opposite the surface is a plane. The jig is fixed to the shaft by use of a single-sided adhesive tape, a double-sided tape, an adhesive, and the like, while the shaft is inserted into the recess. The three-axis accelerometer can be attached to the plane of the jig by use of a single-sided adhesive tape, a double-sided tape, an adhesive, or the like. As a result, the three-axis accelerometer can be fixed securely to the shaft. In this case, the jig is preferably formed from metal in terms of accurate measurement of vibration, especially, from an aluminum alloy having small specific gravity. The three-axis accelerometer may also be fixed directly to the shaft by use of a single-sided adhesive tape, a double-sided adhesive tape, an adhesive, and the like.

Next, in the present invention, the vibration of the golf club in the circumferential direction of the shaft measured by the three-axis accelerometer is analyzed by use of a hand-arm vibration measurement filter. The hand-arm vibration measurement filter is software for extracting a vibration waveform analogous to sensation sensed by the hands and arms of the human within the range of vibration sensed by the human. In this case, a method for analyzing vibration is not limited. Octave band analysis, one-third octave band analysis, or analysis involving wavelet transformation can be preferably adopted. The octave band analysis is a method for analyzing a frequency at a width of one octave. The one-third octave band analysis is a method for analyzing a frequency at a width of one-third octave. One octave becomes a double frequency. Consequently, a frequency which is higher than a frequency of 100 Hz by one octave is 200 Hz. Wavelet transformation is a frequency analysis method which enables simultaneous acquisition of temporal fluctuations or a spatial shift while full use of a characteristic of Fourier transform is being made.

When the vibration in the golf club along the circumferential direction of the shaft measured by the three-axis accelerometer is analyzed by use of the hand-arm vibration measurement filter, analysis of vibration in the golf club at a specific frequency ranging from 30 to 60 Hz, more preferably 35 to 45 Hz, and further preferably 38 to 42 Hz is appropriate. The reason for this is that the arms and hands of the human most easily sense vibration of frequencies in the above ranges.

In the present invention, the feeling of hitting generated by the golf club is evaluated according to the result of analysis of the vibration in the golf club along the circumferential direction of the shaft acquired by the previously-described hand-arm vibration measurement filter. In this case, the method for evaluating the feeling of hitting is not limited. There can be preferably adopted a technique of evaluating the feeling of hitting generated by the golf club from a time difference between the time when the vibration of the golf club in the specific frequency is attained a peak value (the largest value) and a time when a specific value falling within a range from 40 to 80% of the peak value, more preferably a specific value falling within a range from 50 to 75%, and further preferably a specific value falling within a range from 65 to 75%, is achieved. Here, the time difference is a time (time A) from when vibration comes to a value of predetermined percentage of the peak value until when vibration comes to the peak value; a time (time B) from when vibration comes to the peak value until when vibration comes to a value of a predetermined percentage of the peak value; or a total sum of time A and time B. Specifically, the golf club having the longer time A, the longer time B, or the greater sum of time A and time B can be evaluated as a club which provides superior feeling of hitting.

For example, an apparatus shown in FIG. 1 can be mentioned as an apparatus for evaluating feeling of hitting of the golf club of the present invention. The apparatus for evaluating feeling of hitting of a golf club head shown in FIG. 1 includes a three-axis accelerometer 14 attached to the shaft 12 of the golf club 10; a data station 16 connected to the three-axis accelerometer 14; and a personal computer (PC) 18 connected to the data station 16. In FIG. 1, reference numeral 20 designates a head of the golf club 10; and 22 designates a grip of the golf club 10.

Figure 2:
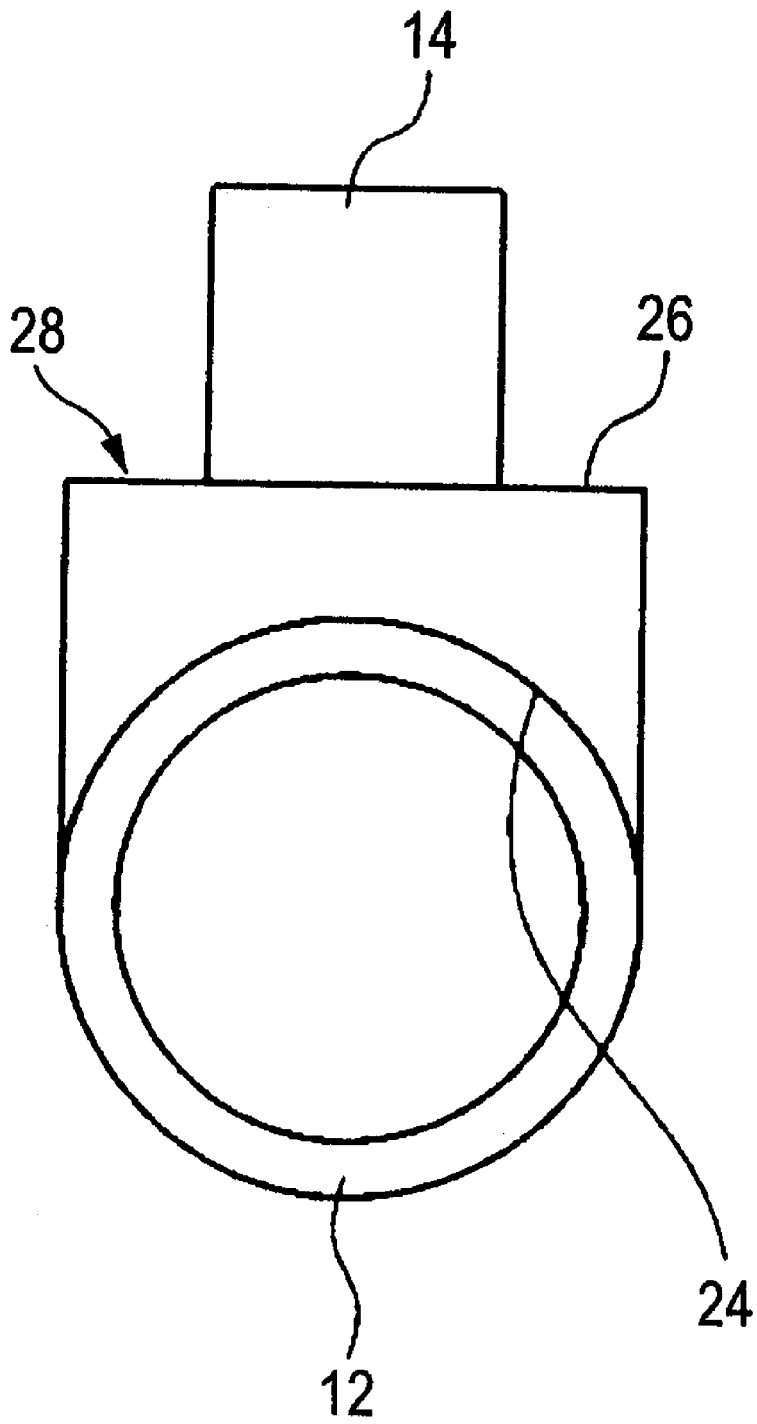
FIG. 2 is a view showing a state where a three-axis accelerometer is attached to a shaft.

In the apparatus of the present embodiment, when the three-axis accelerometer 14 is attached to the shaft 12 of the golf club 10, there is used, as shown in FIG. 2, a block-shaped jig 28 which is made of an aluminum alloy and which has a recess 24 whose one surface has a circular-arc bottom and a plane 26 opposite the bottom. The jig 28 is fixed to the shaft 12 by use of a single-sided adhesive tape, a double-sided adhesive tape, an adhesive, and the like, while the shaft 12 is inserted into the recess 24 of the jig 28. Further, the three-axis accelerometer 14 is attached to the plane 26 of the jig 28 by use of a single-sided adhesive tape, a double-sided adhesive tape, an adhesive, and the like. In the present embodiment, a distance A between a rear end of the shaft 12 and the three-axis accelerometer 14 is set so as to fall within a range from 250 to 300 mm.

In the apparatus of the present embodiment, the three-axis accelerometer 14 measures vibration of the golf club 10 appearing in a direction X (the axial direction of the shaft), a direction Y (the circumferential direction of the shaft), and a direction Z (a direction from the shaft to the heel) when the golf ball is hit by means of the golf club 10. A measurement signal from the three-axis accelerometer 14 is converted by the data station 16 into the number of vibrations. The vibration appearing in the circumferential direction of the shaft of the golf club 10 measured by the three-axis accelerometer 14 is analyzed by use of the arm-hand vibration measurement filter installed in the PC 28.

In this case, in the apparatus of the present embodiment, vibration of the golf club 10—which is at a specific frequency from 30 to 60 Hz and appears in the circumferential direction of the shaft—is analyzed by means of the hand-arm vibration measurement filter. The feeling of hitting of the golf club 10 is evaluated by means of taking, as an index, a time (time A) from when vibration comes to a specific value falling within a range of 40 to 80% of the peak value until the vibration comes to the peak value; a time (time B) from when vibration comes to the peak value until when vibration comes to a specific value falling within the range from 40 to 80% of the peak value; or a total sum of time A and time B.

The feeling of hitting generated by the golf club is evaluated by use of the apparatus shown in FIG. 1. A golf club of iron type is used as the golf club. Specifically, two types of iron heads: namely, an iron head (a soft-iron-forged head) created from soft iron (S20C) by means of forging; and an iron head (titanium face head) a face member formed from a titanium alloy (Ti-6Al-4V) fixedly fitted into an opening of a head main body formed from stainless steel (SUS630) whose face is opened, are used as iron heads. Further, two types of shafts; namely, a steel shaft; and a so-called carbon shaft made of a carbon-fiber-reinforced resin, are used. Moreover, four types of golf clubs; namely, a golf club formed by fixing a steel shaft to a soft-iron-forged head (hereinafter abbreviated as "soft-iron-forged/steel"); a golf club formed by fixing a carbon shaft to the soft-iron-forged head (hereinafter abbreviated as "soft-iron-forged/carbon"); a golf club formed by fixing a steel shaft to the titanium face head (hereinafter abbreviated as a "titanium face/steel"); and a golf club formed by fixing a carbon shaft to the titanium face head (hereinafter abbreviated as "titanium face/carbon"), are created.

In the apparatus shown in FIG. 1, a three-axis accelerometer exhibiting sensitivity at a frequency from 0.5 Hz to 2000 Hz is used. The distance A between the rear end of the shaft and the three-axis accelerometer is set to 280 mm. The three-axis accelerometer is affixed to the shaft by means of a double-sided adhesive tape and without use of the previously-described jig. Further, an adhesive tape is coiled around the shaft and the three-axis accelerometer in order to prevent removal of the shaft and the accelerometer in the middle of swinging action. In relation to measurement, the vibration appearing when a golfer actually hits a golf ball by use of the head is measured by use of the three-axis accelerometer. Specifically, the followings are used as devices and software.

Three-axis accelerometer: NP-3560B manufactured by Ono Sokki Co., Ltd.

Vibration measurement device: Data Station DS2000 Graduo manufactured by Ono Sokki Co., Ltd.

Signal conversion-recording software: Throughput disk software DS0250 manufactured by Ono Sokki Co., Ltd.

Analysis software: Real-time octave analysis software DS0223 manufactured by Ono Sokki Co., Ltd.

Figure 3:
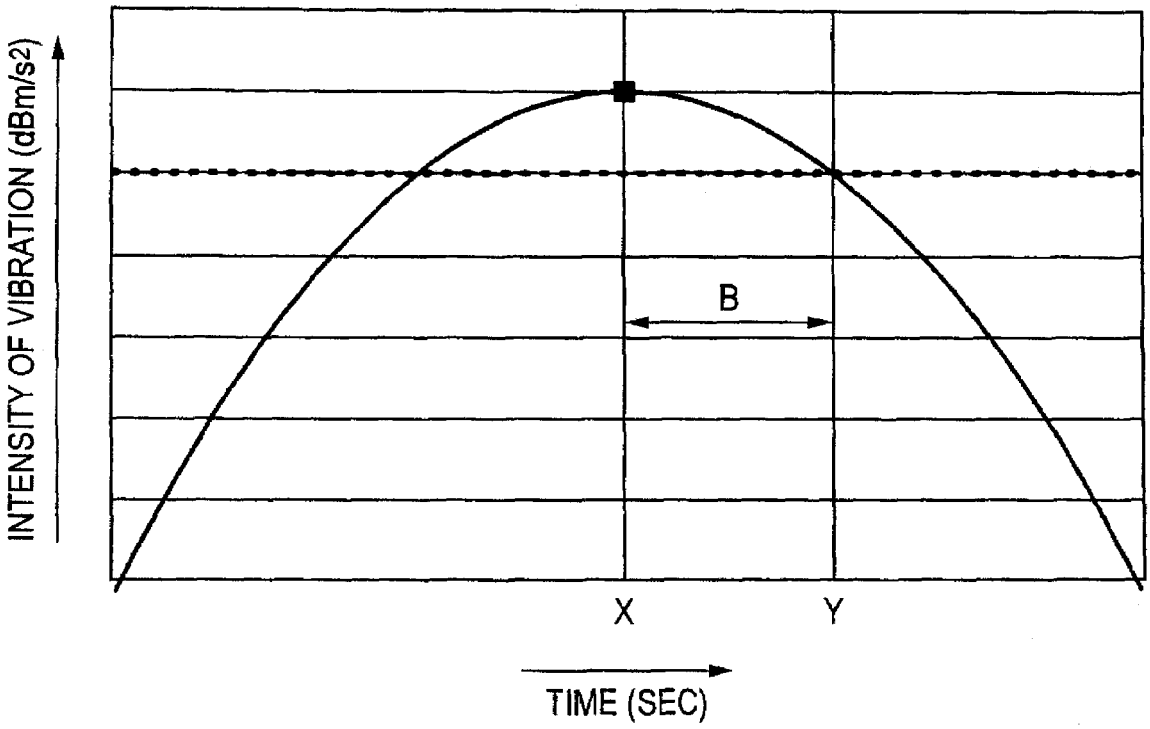
FIG. 3 is a graph showing time B from time X when vibration of the golf club comes to a peak value until time Y when vibration comes to a value corresponding to 75% of the peak value.

As to analysis, one-third octave band analysis is performed by use of the hand-arm vibration measurement filter. In this case, vibration of the golf club in the circumferential direction of the shaft at a specific frequency of 40 Hz is analyzed by means of the hand-arm vibration measurement filter. As shown in FIG. 3, the feeling of hitting is evaluated by means of taking, as an index, time B from time X when vibration comes to the peak value until time Y when vibration comes to a value corresponding to 75% of the peak value.

Figure 4:
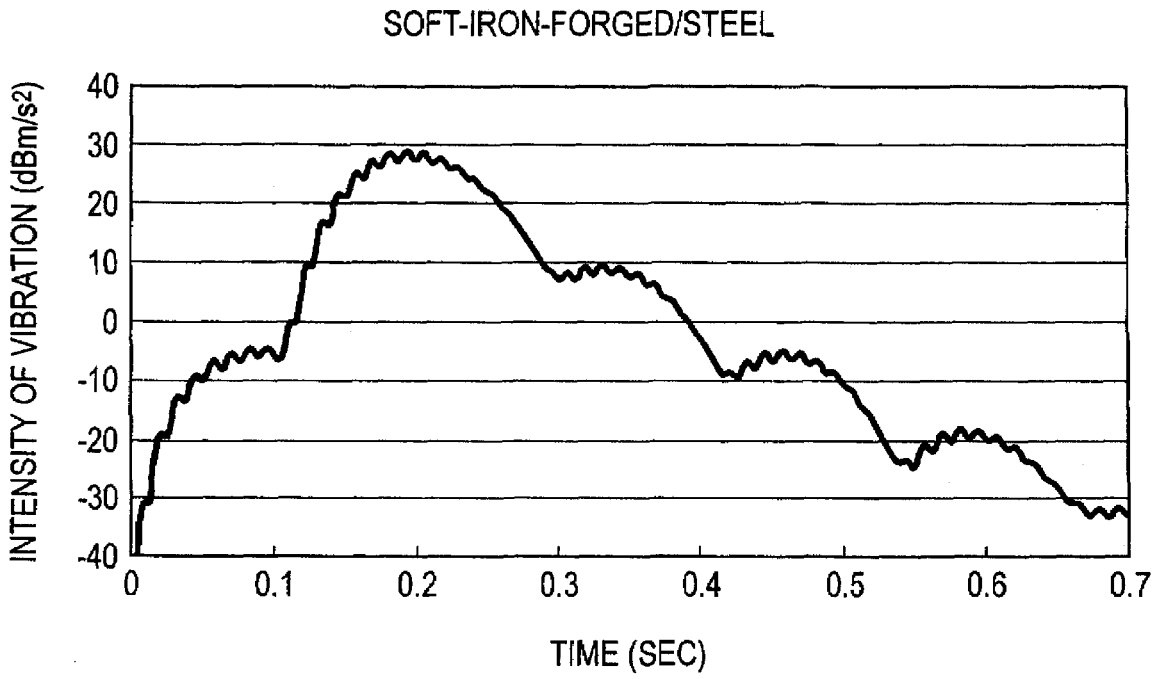
FIG. 4 is a graph showing the waveform of vibration at a frequency of 40 Hz appearing in a golf club (soft-iron-forged/steel) measured in the embodiment.
Figure 5:
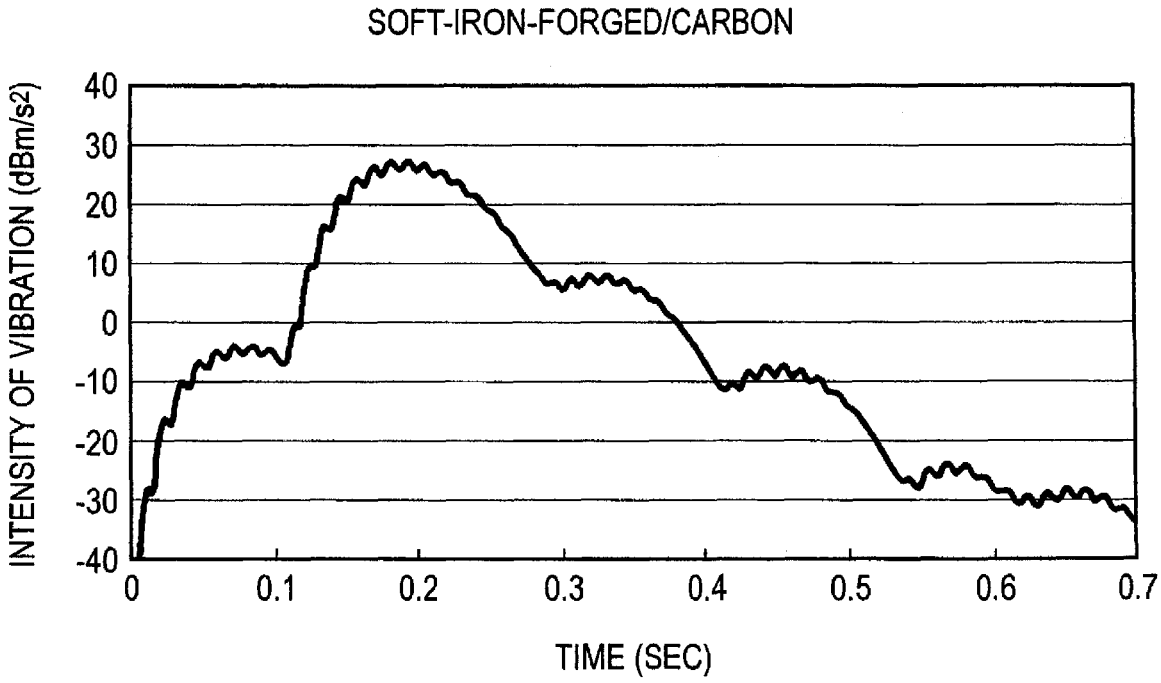
FIG. 5 is a graph showing the waveform of vibration at a frequency of 40 Hz appearing in a golf club (soft-iron-forged/carbon) measured in the embodiment.
Figure 6:
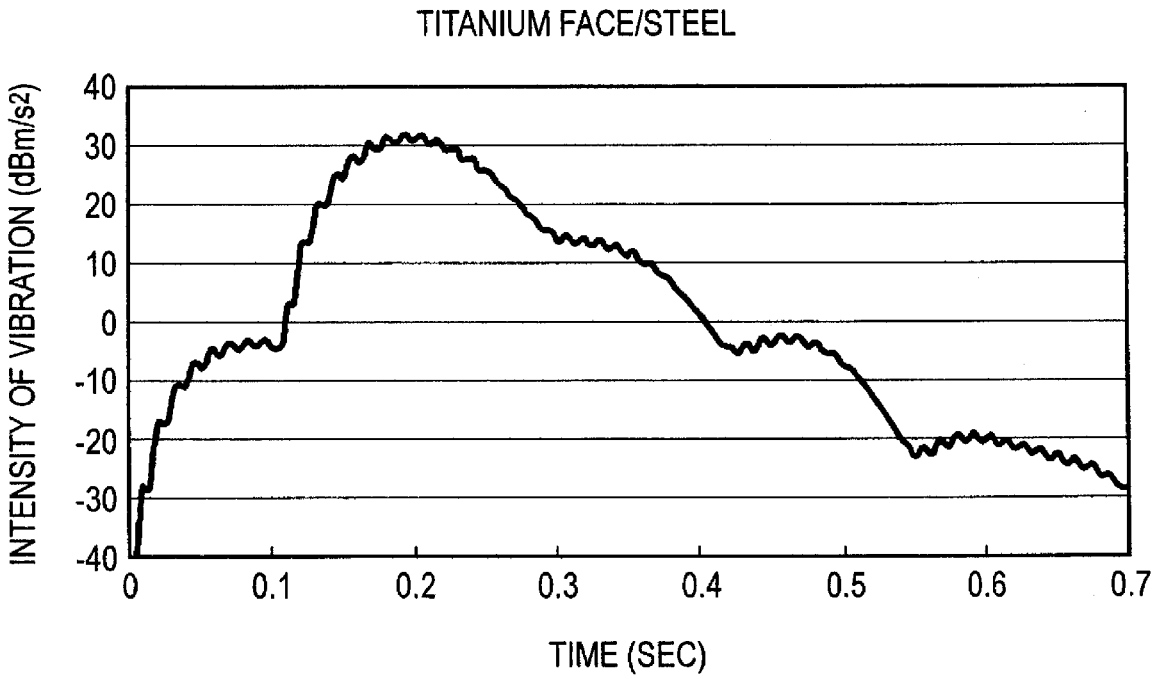
FIG. 6 is a graph showing the waveform of vibration at a frequency of 40 Hz appearing in a golf club (titanium face/steel) measured in the embodiment.
Figure 7:
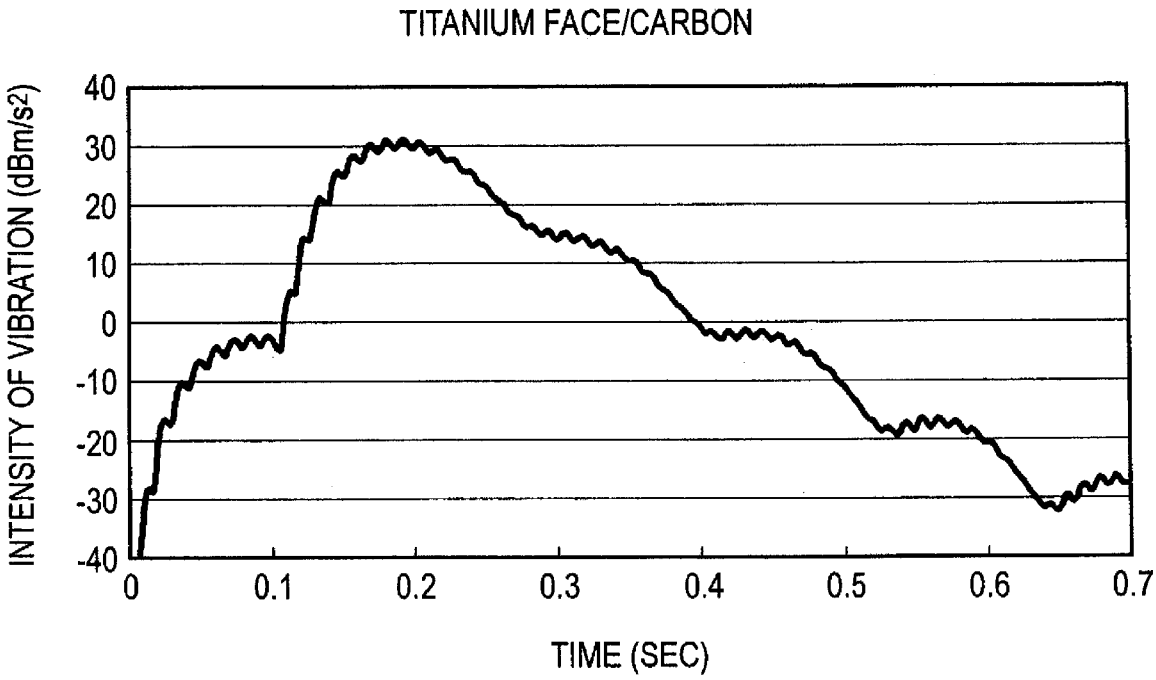
FIG. 7 is a graph showing the waveform of vibration at a frequency of 40 Hz appearing in a golf club (titanium face/carbon) measured in the embodiment.
Figure 8:
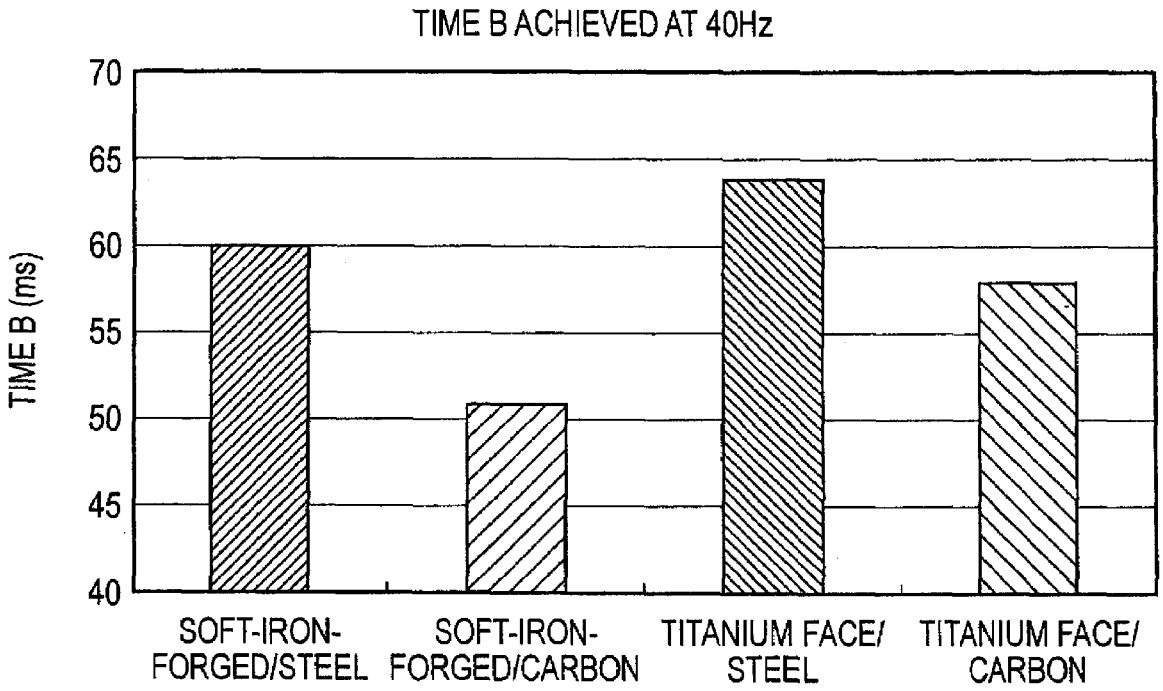
FIG. 8 shows results of times B pertaining to the vibration of the golf club at a specific frequency 40 Hz measured in the present embodiment.

FIGS. 4 through 7 show time-varying changes in the vibration of the golf club appearing in the circumferential direction of the shaft appearing when the golf ball is hit by use of the respective golf clubs. FIG. 4 shows a result of the soft-iron-forged/steel golf club; FIG. 5 shows a result of the soft-iron-forged/carbon golf club; FIG. 6 shows a result of the titanium face/steel golf club; and FIG. 7 shows a result of the titanium face/carbon golf club. FIG. 8 shows results of times B achieved by the respective golf clubs. In the present embodiment, a golf club which yields a longer time B is evaluated as a golf club exhibiting superior feeling of hitting. Consequently, the golf clubs are evaluated in descending sequence of superior feeling of hitting: namely, the titanium face/steel golf club>the soft-iron-forged/steel golf club>the titanium face/carbon golf club>the titanium face/steel golf club.

Figure 9:
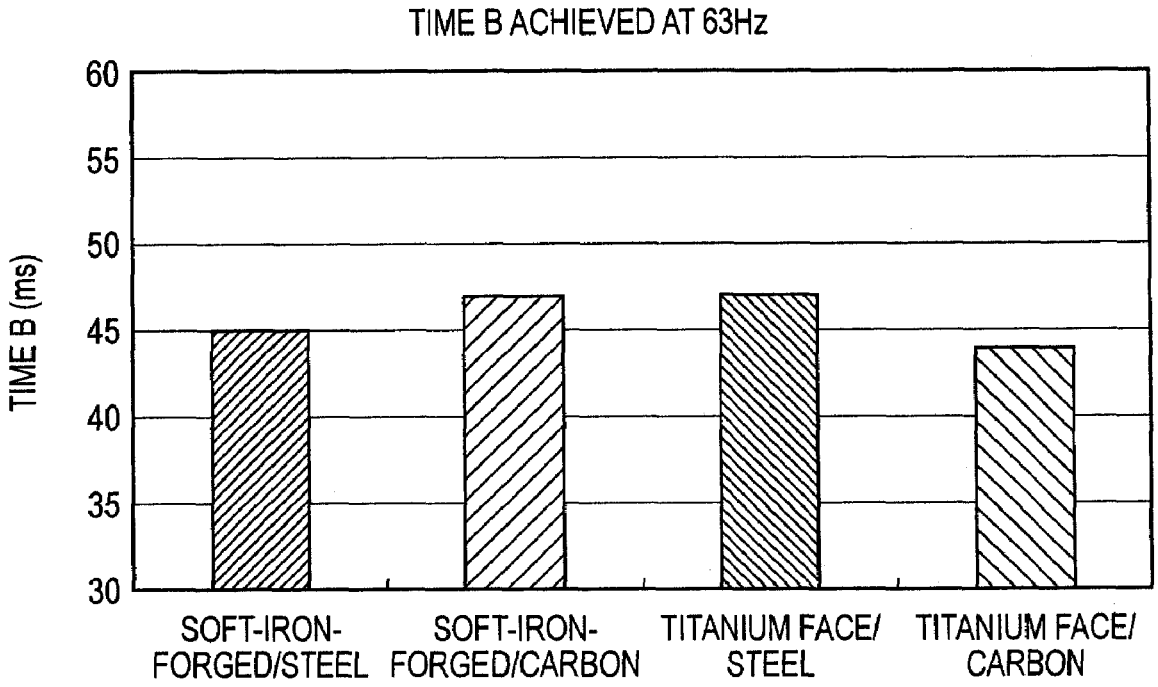
FIG. 9 shows results of times B pertaining to the vibration of the golf club at a specific frequency 63 Hz measured in the present embodiment.

FIG. 9 shows results of times B pertaining to the vibration of the golf club at a specific frequency of 63 Hz and along the circumferential direction of the shaft. As can be seen from FIG. 9, when the specific frequency is 63 Hz, a difference between times B achieved by the respective golf clubs is small, and characteristics of the golf clubs are less likely to appear. Accordingly, appropriate evaluation of feeling of hitting generated by the golf clubs is understood to be difficult. Moreover, in the present embodiment, the feeling of hitting is evaluated according to the duration of the time B. However, another element; for example, the intensity of vibration, can be considered to be solely taken as an index for evaluation of the feeling of hitting. Alternatively, the intensity of vibration and time A, time B or the sum of time A and time B can be considered to be taken as an index for evaluation of feeling of hitting.

What is claimed is:

1. A method for evaluating feeling of hitting of a golf club having a three-axis accelerometer disposed on an outer side of a shaft of the golf club, comprising:

measuring, by the three-axis accelerometer disposed on the outer side of the shaft, vibration of the golf club appearing in a circumferential direction of the shaft when a golf ball is hit by the golf club;

analyzing, by a hand-arm vibration measurement filter, the vibration measured by the three-axis accelerometer; and evaluating the feeling of hitting of the golf club in accordance with an analysis result of the hand-arm vibration measurement filter, wherein a distance between a rear end of the shaft and the three-axis accelerometer ranges from 250 to 300 mm, and wherein when the feeling of hitting of the golf club is evaluated in accordance with the analysis result of the hand-arm vibration measurement filter, the feeling of hitting of the golf club is evaluated in accordance with a time difference between a time when the vibration of the golf club in the specific frequency has attained a peak value and a time when a specific value falls within a range from 40 to 80% of the peak value.

2. The method for evaluating feeling of hitting of a golf club according to claim 1, wherein:

the three-axis accelerometer is attached to the shaft of the golf club by a block-shaped jig including one surface that has a circular arc shape so as to form a recess and another surface opposite the one surface that is planar, the jig is fixed to the shaft by inserting the shaft into the recess; and the three-axis accelerometer is attached to the planar surface of the jig.

3. The method for evaluating feeling of hitting of a golf club according to claim 1, wherein when the vibration in the golf club head along the circumferential direction of the shaft measured by the three-axis accelerometer is analyzed by the hand-arm vibration measurement filter, vibration in the golf club appearing in the circumferential direction of the shaft at a specific frequency ranging from 30 to 60 Hz is analyzed.

4. An apparatus for evaluating a feeling of hitting of a golf club, the apparatus comprising:

a three-axis accelerometer disposed on an outer side of a shaft of a golf club, the three-axis accelerometer measuring vibration of the golf club appearing in a circumferential direction of the shaft when a golf ball is hit by the golf club; and a computer which captures a signal pertaining to the vibration measured by the three-axis accelerometer and which analyzes the vibration through use of a hand-arm vibration measurement filter, wherein a distance between a rear end of the shaft and the three-axis accelerometer ranges from 250 to 300 mm, and wherein the feeling of hitting of the golf club is evaluated in accordance with a result of the hand-arm vibration measurement filter and in accordance with a time difference between a time when the vibration of the golf club in a specific frequency has attained a peak value and a time when the vibration of the golf club has attained a specific value within a range from 40 to 80% of the peak value.

* * * * *